United States Patent [19]

Noirjean

[11] Patent Number: 5,003,519

[45] Date of Patent: Mar. 26, 1991

[54] ALARM ARRANGEMENT FOR A TIMEPIECE

[75] Inventor: Pierre-André Noirjean, Courfaivre, Switzerland

[73] Assignee: ETA S.A. Fabriques d'Ebauches, Grenchen, Switzerland

[21] Appl. No.: 356,867

[22] Filed: May 25, 1989

[30] Foreign Application Priority Data

May 26, 1988 [CH] Switzerland ..... 01996/88

[51] Int. Cl.[5] ..... G04B 23/02; G04C 21/16

[52] U.S. Cl. ..... 368/73; 368/250; 368/252

[58] Field of Search ..... 368/72–74, 368/109, 250, 252, 253, 243, 244

[56] References Cited

U.S. PATENT DOCUMENTS

| | | | |
|---|---|---|---|
| 3,079,749 | 3/1963 | Ryser | 368/74 |
| 3,596,460 | 8/1971 | Wuthrich | 58/19 |
| 3,611,702 | 10/1971 | Spandini | 58/19 |
| 3,783,599 | 1/1974 | Tanaka | 368/74 |
| 3,910,034 | 10/1975 | Tilse | 368/250 |
| 4,040,248 | 8/1977 | Laesser | 368/252 |
| 4,157,646 | 6/1979 | Wuthrich | 58/19 B |
| 4,253,177 | 2/1981 | Hafner | 368/294 |
| 4,351,043 | 9/1982 | Ogihara et al. | 368/252 |
| 4,427,301 | 1/1984 | Cleusix | 368/72 |
| 4,618,264 | 10/1986 | Kamens et al. | 368/74 |

FOREIGN PATENT DOCUMENTS

| | | |
|---|---|---|
| 2250147 | 5/1975 | France . |
| 445394 | 2/1968 | Switzerland . |
| 2191610 | 12/1967 | United Kingdom . |

*Primary Examiner*—Vit W. Miska

*Attorney, Agent, or Firm*—Griffin Branigan & Butler

[57] ABSTRACT

The alarm arrangement is among those in which an alarm is released by the coincidence of a first contact point coupled to the going train of the timepiece with a second contact point coupled to an index the position of which may be regulated by a manual control element. In this arrangement the second contact point (68) is coupled to a member (60) fixed to a rotating shaft (58) on which are pivoted wheel sets (76, 92) of the going train which bear time indicating hands (82, 100). In a very simple case the member fixed to the rotating shaft is adjacent the timepiece hour wheel (80) and the contact points (68, 90) are borne by these two elements on their faces and facing one another. On the other hand the manual control element may be advantageously formed by the glass (16) of the timepiece which is then coupled to one of the ends of the rotating shaft and a rotatable bezel (22) to which the glass is fastened.

21 Claims, 3 Drawing Sheets

ALARM ARRANGEMENT FOR A TIMEPIECE

More precisely, the invention has as its object an alarm arrangement which is intended more particularly for a small electric alarm clock and which may be classified among those in which an alarm is released by the coincidence of a first contact point coupled to a going train included in the timepiece, with a second contact point coupled to an index, the position of which may be set by a manual control element.

BACKGROUND OF THE INVENTION

In known arrangements of this type, the index is generally formed by a hand which is borne by a cannon wheel arranged on the hour wheel pipe and which may be displaced by turning a knob.

Among these arrangements, there are certain where the two contact points are situated on the facing surfaces of the hour wheel and the wheel which bears the alarm hand, otherwise known as the alarm wheel and where this latter meshes directly with a pinion mounted on the same rotatable stem as the setting knob.

These arrangements are thus very simple and very economical.

The purpose of the invention is to provide an alarm arrangement which may be still more simple.

SUMMARY OF THE INVENTION

This purpose is attained in view of the fact that in the alarm arrangement in accordance with the invention the second contact point is coupled to a member fixed to a rotatable shaft on which may be pivoted wheel sets of the timepiece going train which bear time indicating hands.

Effectively, in view of this arrangement, it is possible, particularly in the case of a small clock, to adjust the position of the second contact point which corresponds to the time at which the alarm must act by acting directly on the rotatable shaft.

This action may be brought about for instance by means of a button formed or fixed to one of the ends of this shaft and located at the back of the clock such as a time setting knob in the classical alarm clock or in front of the latter such as a time setting knob for a vehicle dashboard clock.

Placing the knob in front of the clock rather than at the back gives rise to an advantage, i.e. it renders the adjustment of the alarm time both easier and faster since there is no need to turn the clock or to feel around in order to find the knob. Unfortunately, such an arrangement is not entirely satisfactory, in particular from the aesthetic viewpoint.

The invention likewise has as its purpose to bring about a solution to this aspect of the problem.

The solution to this problem consists in coupling the rotatable shaft of the alarm arrangement to the glass of the timepiece and fastening this glass to a rotatable bezel in order to permit utilization of these two elements as a manual control unit.

In this case one may provide on the glass any marking whatsoever, for instance a coloured arrow glued or painted thereon which serves as index and is generally easier and more economical than fastening an alarm hand on the rotatable shaft.

As may be well understood, it is likewise possible that the bezel itself bears the index and not the glass.

Other characteristics and advantages of the invention will appear upon reading of the description which follows and from reference to the annexed drawings.

DESCRIPTION OF THE PREFERRED EMBODIMENT

Figure 1:
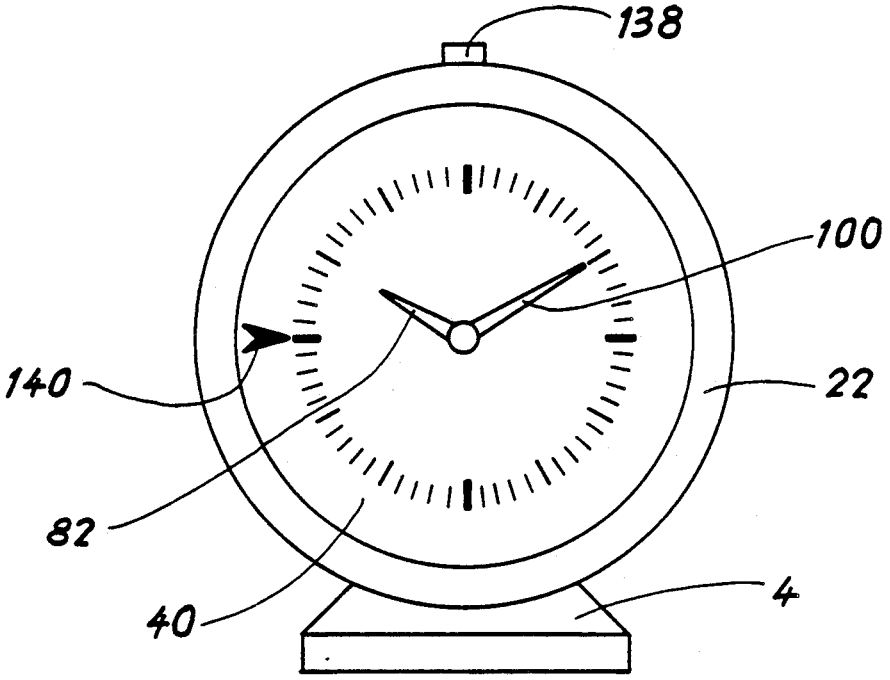
FIG. 1 is a face view of a small alarm clock provided with an alarm arrangement in accordance with the invention, the manual control element of which is effectively formed by the glass of the clock and a rotatable bezel to which this is fixed.
Figure 2:
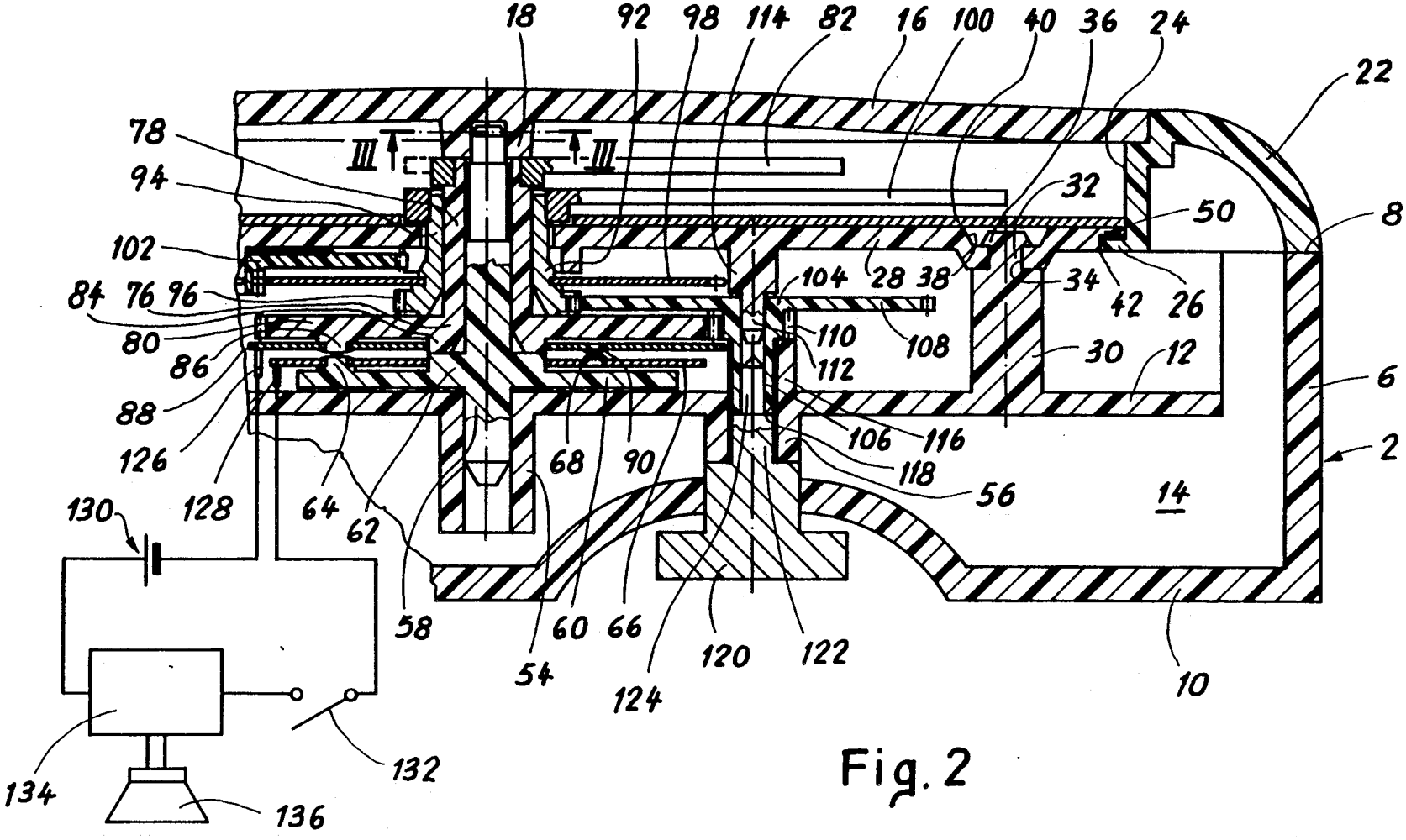
FIG. 2 is a partial axial cross-section of the clock of FIG. 1.

The small alarm clock as represented on FIGS. 1 and 2 comprises a part of plastic material 2 which at the same time forms a foot 4, a cylindrical case 6 with an edge 8 and a back cover 10 borne by foot 4, a plate 12 arranged within the case 6 perpendicularly to its axis and a wall 14 for supporting the plate.

Such clock likewise comprises a round glass of transparent plastic material 16, the internal surface of which exhibits at its center an annular collar 18 and of which the edge is fastened for instance by gluing or ultrasonic welding to a bezel 22 likewise of plastic material, the outer diameter of which is substantially equal or slightly greater than that of the case.

Figure 3:
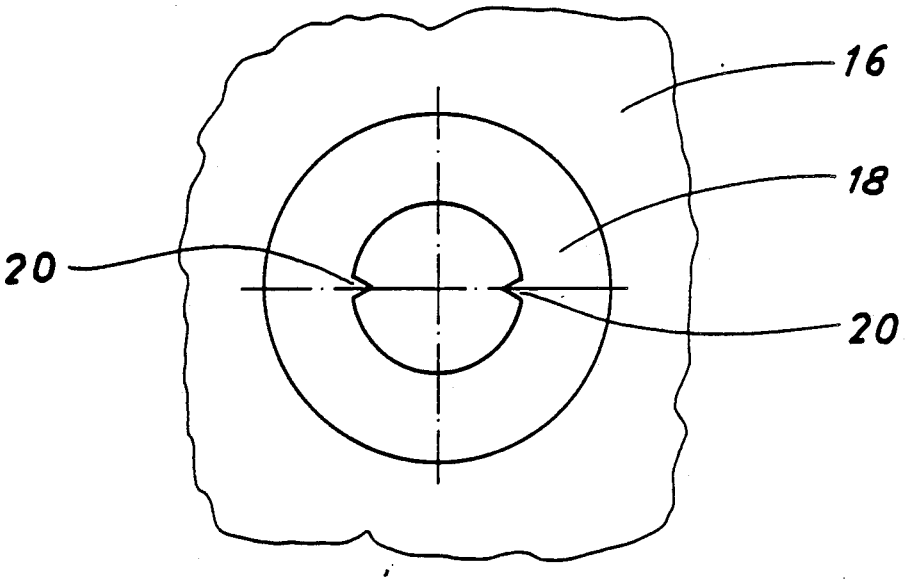
FIG. 3 is a partial cross-section on an enlarged scale in accordance with line III—III of FIG. 2.

As is shown on FIG. 3, the annular collar 18 includes at the interior thereof two spurs 20 parallel to the axis of the glass and diametrically opposed, the use of which will appear hereinafter.

As to bezel 22 it will be observed according to FIG. 2 that it exhibits an internal cylindrical wall 24 having at its base an annular lip 26 directed towards the interior.

Such as it is shown the contour of its profile is approximately in the form of a quarter of a circle but it could also have another form.

What is important is that the assembly, i.e. the glass and the bezel, is mounted at the front of the case 6 in a manner to be capable of rotating about its axis whilst at the same time remaining in contact with the edge 8. Hereinafter will be seen how this assembly is brought about.

Thus, a certain number of risers which emanate from plate 12 and back cover 10 likewise form a portion of part 2. At the extremities of these is fastened a disc 28 likewise of plastic material which is centered on the axis of the case 6 and parallel to plate 12, and the diameter of which is equal to that of the internal cylindrical wall 24 of bezel 22.

FIG. 2 shows one only of these risers designated by reference 30. As in the case of the others, it exhibits at its top a tenon 32 which passes through a hole 34 of the disc, the end of which is flattened in order to form a head 36 and to seize the edge of hole 34 between such head and the bearing surface which is found at the boundary between the tenon 32 and the remainder of the riser. This may be realized for instance by causing the end of the tenon to fuse by means of ultrasonic treatment in order not only to obtain head 36 but likewise to weld it to the disc.

Furthermore, it will be noted that hole 34 is located at the bottom of a small cup 38 in order that head 36 does not go beyond the front surface of the disc so that this surface may directly bear a dial 40 fixed thereto for instance by gluing and of the same diameter as the disc.

It will likewise be noted that this disc exhibits just behind its periphery an annular rabbet 42 which has the same width as lip 26 of the bezel and in which the latter is engaged.

Figure 4:
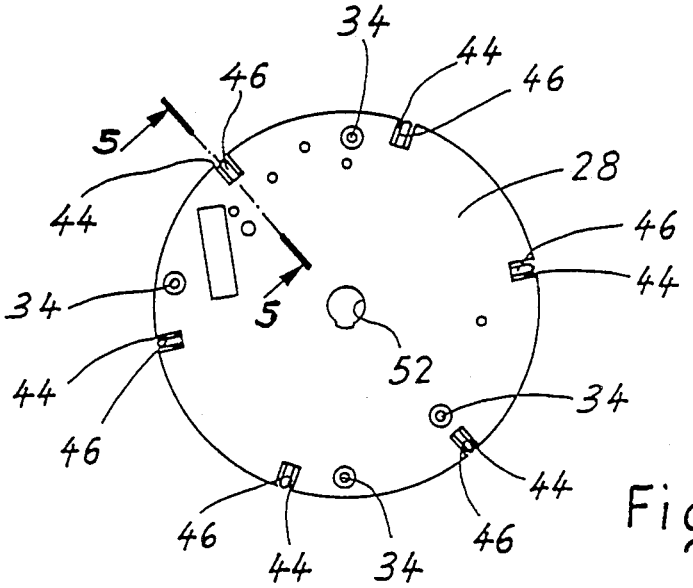
FIG. 4 is a top view of an important part of the clock which serves in particular to maintain the crystal and the bezel axially in place and to guide these elements in rotation.

If one now refers to FIG. 4, it will be noted that disc 28 includes at its periphery a certain number of regularly spaced out notches 44, for example six, and as many radial tongues 46 which emanate from the bottom of these notches in order to extend almost to the edge of the disc.

Figure 5:
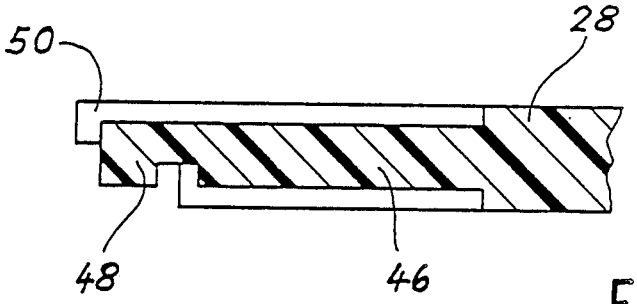
FIG. 5 is a partial cross-section on an enlarged scale of the same parts according to line V—V of FIG. 4.

As is shown on FIG. 5, these tongues 46 are thinner than the disc in order to be able to exhibit a certain elasticity in the direction perpendicular to the latter.

Furthermore, each of these exhibits at its end and at the side of the back surface of the disc a stub or a small skid 48 the end of which is located at a level included between the planes in which are situated the back faces of disc 28 and of its thinned down peripheral portion 50.

When the clock is assembled, bezel 22 is axially captured between the edge 8 of the case and the skids 48 which bear against lip 26 and it may turn in both senses with the glass and about its axis in being guided by the bearing surface of the disc which is located at the limit between the back face and that of its thinned out portion.

The presence of tongues 46 and skids 48 enables at the same time to avoid axial play of the bezel and to have available certain tolerances for the manufacture of this bezel, of the disc 28 and of the risers 30 at the end of which it is fastened. On the other hand, if these tongues and these skids were not present and if the entire thinned out portion 50 of the disc were in contact with lip 26 of the bezel, the rubbing forces between these two elements would be much more significant. It would thus be difficult to bring about rotation of the bezel, this latter running the risk of jamming.

This function of disc 28 which consists in cooperating with the edge of the case in order to maintain in axial position the glass and the bezel to guide these in rotation is in fact the second which is to be noted, the first being that of supporting the dial. Such disc likewise has a third function: it serves as a base plate for the movement of the clock. It is the reason for which one may see on FIG. 4 in addition to the central hole 52 and notches 44, tongues 46 and holes 34 which have already been mentioned, a certain number of round holes for the assembly of certain parts of the movement and a larger rectangular hole for the winding of the stepping motor which is normally fastened behind the disc.

If one now consider's again FIG. 2, it will be noted that plate 12 exhibits at the side of the back cover of the case two hollow cylindrical protuberances 54 and 56.

The first of these protuberances 54 forms a bearing in which is engaged one of the ends of a shaft 58 of plastic material which traverses disc 28 and dial 40 at the center thereof and which extends to the annular collar 18 of the glass in which it penetrates and to which it is fastened by simply forcing it to the interior thereof. At this moment the two internal spurs 20 of the collar will provide corresponding grooves in the end of the shaft which assures that the glass will not run a risk of rotating without driving the shaft with it.

This shaft 58 which evidently forms the rotatable shaft already spoken of is here formed integrally with disc 60, the rear face of which is located very close or in contact with plate 12 and the front face of which exhibits a cylindrical boss 62 of small height at its center as well as several smaller studs 64 close to its periphery.

These studs 64 which may for instance be three in number serve as feet for a circular plate of conductive material, more precisely a metallic plate 66 which has been fastened thereon by using for instance the technique of ultrasonic welding and which has a diameter slightly greater than that of disc 60.

This metallic plate 66 exhibits on the side opposite to the disc a small rounded stud 68 which constitutes the second contact point of the alarm arrangement of the clock.

Figure 6:
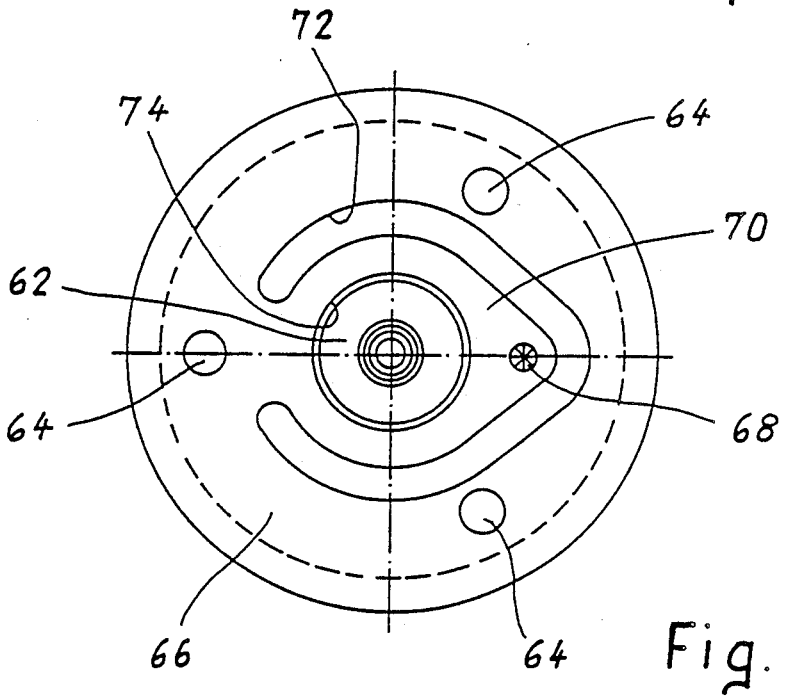
FIG. 6 is a face view of another part of the clock which shows how the contacts of the alarm arrangement are obtained.

As may be seen on FIG. 6, stud 68 is located at the end of a tongue 70 which has been formed in plate 66 by punching out an opening 72 and which shows in its central portion a round hole 74 through which passes the central boss 62 of the disc.

Thus when pressure is exerted on boss 68 of the plate, tongue 70 which shows a certain elasticity may be pressed back in the space which separates the plate from the front face of the disc and take up its normal position when pressure on the boss ceases.

On the part of shaft 58 situated between disc 60 and the collar 18 of the glass there is engaged an hour cannon wheel 76 likewise of plastic material which comprises a pipe 78 at one end of which is fastened an hours hand 82 and on the other end an hour wheel 80.

This hour wheel 80 shows on its back surface a central collar 84 the outer diameter of which is equal to the diameter of the boss 62 of disc 60 with which it is in contact and studs 86 which, like studs 64 of the disc, constitute the feet on which is fastened a circular metallic plate 88.

As in the case of plate 66 which is slightly smaller than it, this plate 88 exhibits a small rounded stud 90 located at the end of an elastic tongue formed in the same manner as tongue 70 (see FIG. 5).

This stud 90 which constitutes the first contact point of the alarm arrangement of the clock and stud 68 of plate 66 are evidently located substantially at the same distance from the axis of shaft 58 in order to meet one another and to pass one above the other in forcing the tongues which bear them to be slightly deformed when the hour wheel turns relative to the disc 60 or vice versa.

In a general manner, in a mechanical or electromechanical timepiece, the hour wheel is borne on a cannon-pinion to which is fastened a minutes hand and this minutes hand is in front of the hours hand.

In the clock in accordance with the invention as described, it is exactly the contrary. It is about the pipe 78 of the hour wheel 76 which is mounted a cannon-pinion 92 and the minutes hand 100 which is borne on this cannon pinion is closer to the dial than the hours hand 82.

However, the cannon -pinion 92 which may for instance be metallic, comprises as is usual a tube 94 at the end of which is fastened the hand 100, a minutes pinion 96 and a minutes wheel 98 which are evidently all rigid with one another. The minutes wheel is coupled via several intermediate wheel sets to the rotor of the motor which is fastened behind disc 28 and which is controlled in a well known manner by an electronic circuit comprising a quartz oscillator, a frequency divider and a pulse forming circuit in order to produce and apply to the motor winding, motor driving pulses in response to the pulses provided by the divider.

As in the case of the motor, the control circuit has not been shown on FIG. 2.

In fact this figure shows only a portion of the last intermediate wheel set 102 which is mounted behind disc 28 and the pinion of which meshes with the minutes wheel 98.

The minutes pinion 96 itself is coupled to the hours wheel 80 via a wheel set of the motion work 104.

This wheel set of the motion work 104 which may be formed for instance of plastic material comprises a hollow central tube 106, a motion work wheel 108 which meshes with the minutes pinion 96 and a motion work pinion 110 which is engaged with the hours wheel 80.

On the other hand, shaft 106 may pivot at one of its ends around a pivot 112 located at the end of a riser 114 and provided behind disc 28 and at its other end at the interior of a protuberance 116 taking the form of a hollow cylinder and of a hole 118 in plate 12 which brings about communication of the interior of this protuberance 116 with that of protuberance 56 provided on the other side.

In order to provide hour setting the clock likewise comprises a knob 120 which is located behind its case.

This setting knob 120 comprises a single piece in plastic material with a time setting stem 122 which passes to the interior of protuberance 56 and which terminates in a joining piece 124 of smaller diameter which is engaged on the interior of tube 106 of the motion work wheel set 104.

Furthermore, in order to be at the same time rigid in rotation with wheel set 104 and capable of disassembly, this stem 122 exhibits beyond the joining portion 124 two diametrically opposite flattened portions which engage in two corresponding axial notches of tube 106.

The latter is not visible on FIG. 2.

On the other hand, this figure shows very schematically the realization of the electric alarm circuit which is formed in part of metallic plates 66 and 88 with their contacts 68 and 90.

This circuit comprises two sweeps, for instance two metallic blades 126 and 128 which are each in contact with the back surface of one of the plates 66 and 88 and which rub against these plates when they are rotated.

One of these sweeps 126 is directly connected to the negative pole of the energization source 130 of the clock. The other sweep 128 is coupled to the positive terminal of this source via a switch 132 the opening and closing of which may be controlled by means of a knob 138 placed above the clock and which may be seen on FIG. 1 and of a control circuit 134 for a buzzer 136.

Finally, as is also shown on FIG. 1, glass 16 of the clock bears at its periphery an index more precisely a black or coloured arrow 140 which is glued or painted on the internal surface and which is located entirely or principally above a zone of the dial 40 which surrounds its graduations in order to avoid masking certain of the latter.

According to what was mentioned at the beginning, it is clear that this arrow on the glass may be replaced by a small element fastened in an adequate manner to the internal wall 24 of the bezel.

In one or the other of these cases, when one turns the bezel and the glass in order to bring the index into the position where it indicates the alarm time as chosen, there will be displaced at the same time disc 60 and contact 68 of the metallic plate 66 to a position which corresponds to that of the index.

Thereafter, as soon as the contact 90 of plate 88 touches contact 68 at the time indicated by the index, the control circuit 134 controls the buzzer 136 and the latter will emit an audible signal, it being nevertheless well understood that knob 138 has been raised and switch 132 closed. If such is not the case, nothing will happen.

When buzzer 136 emits a signal, it is possible to interrupt it in pressing on button 138 and thus opening switch 132 or to wait until circuit 134 at the end of a predetermined time itself terminates the audible signal.

What I claim is:

1. An alarm timepiece comprising:

support means;

a dial borne by said support means;

a shaft rotatably mounted on said support means;

a going train operatively mounted on said support means and comprising a plurality of wheels including an hour wheel and a minute wheel, said hour wheel and said minute wheel being rotatably mounted around said shaft;

an hours hand and a minutes hand coupled to said hour wheel and said minute wheel, respectively, so as to cooperate with said dial to display time;

a first contact point rigid with one of said wheels of said going train;

a member fixed to said shaft for rotation therewith;

a second contact point coupled to said member;

manual control means operatively coupled to said member for setting the position of said member and said second contact point, said position being representative of the alarm time at which an alarm must be triggered;

an index coupled to said manual control means for displaying said alarm time; and, alarm-producing means for producing an alarm when the positions of said first and second contact points coincide with one another by virtue of rotational movement of said one of said wheels with respect to said member.

2. An alarm timepiece as claimed in claim 1 wherein said member and said hour wheel are adjacent one another and have faces facing one another, and wherein said first and second contact points are borne by said member and said hour wheel on said faces.

3. An alarm timepiece as claimed in claim 2 wherein said member and said hour wheel are formed of insulating material; and two conductive plates fixed to said faces, said contact points comprising projections from said plates.

4. An alarm timepiece as claimed in claim 3 wherein said projections comprise elastic tongues struck out from said plates.

5. An alarm timepiece as claimed in claim 1 wherein said manual control means comprises a rotatable bezel mounted on said support means, on the side of said dial, and a glass fixed to said bezel and coupled to one end of said shaft.

6. An alarm timepiece as claimed in claim 5 wherein said glass and said end of said shaft are coupled by means of an annular collar formed on the inside of said glass, said end of said shaft being inserted into and retained by said annular collar.

7. An alarm timepiece as claimed in claim 5 wherein said index comprises a mark borne by said glass.

8. An alarm timepiece as claimed in claim 5 wherein said index is borne by said bezel.

9. An alarm timepiece as claimed in claim 5 further comprising a case provided behind said dial, and wherein said support means comprises a disc rigidly fixed to said case and bearing said dial, and about which said bezel is rotatably mounted.

10. An alarm timepiece as claimed in claim 9 wherein said bezel has an internal lip and said case has a front edge, and wherein said bezel is maintained in place axially by said disc which bears on said lip of said bezel and said front edge against which said bezel bears in turn.

11. An alarm timepiece as claimed in claim 10 wherein said internal lip engages in a rabbet formed on the periphery of said disc and on the side opposite and dial so as to be guided in rotation by said disc.

12. An alarm timepiece as set forth in claim 11 wherein said disc bears on said internal lip by means of a plurality of pads which penetrate into said rabbet and which are located on the ends of elastic tongues accommodated in notches in the disc and regularly distributed around the periphery thereof.

13. An alarm timepiece as set forth in claim 1 wherein said going train comprises an hour cannon wheel directly mounted around said shaft and comprising a first pipe which bears said hour wheel and at one end of which is fastened said hours hand, and a cannon pinion mounted around said first pipe and comprising a second pipe which bears said minute wheel and at one end of which is fastened said minutes hand which is then closer to said dial than said hours hand.

14. An alarm timepiece comprising:

a support means;

a shaft rotatably supported on said support means;

a going train operatively mounted on said support means and comprising a plurality of wheels including an hour wheel and a minute wheel rotatably mounted around said shaft;

a first contact point on one of said wheels of said going train;

a member fixed to said shaft for rotation therewith;

a second contact point on said member;

alarm-producing means for producing an alarm when said first and second contacts touch; and, a manual control means for setting an alarm time, said manual control means comprising rotatable bezel mounted on said support means and a glass fixed to said bezel and coupled to one end of said shaft whereby rotation of said bezel sets the position of said second contact, said position representing the time at which the alarm-producing means produces the alarm.

15. An alarm timepiece as claimed in claim 14 and further comprising:

a dial supported by said support means; and, an hours hand and a minutes hand coupled to said hour wheel and said minute wheel, respectively, and cooperating with said dial to display time.

16. An alarm timepiece as claimed in claim 14 and further comprising index means borne by said manual control means.

17. An alarm timepiece as claimed in claim 14 and further comprising:

a case; and, a disc fixed to said case, said bezel being rotatably mounted about said disc.

18. An alarm timepiece as claimed in claim 17 and further comprising an internal lip on said bezel, said disc being maintained axially by said disc which bears on said internal lip at a front edge of said case, said bezel also bearing on said front edge of said case.

19. An alarm timepiece comprising:

a support means;

a shaft rotatably supported on said support means;

a going train operatively mounted on said support means and comprising a plurality of wheels including an hour cannon wheel and a minute cannon wheel;

said hour cannon wheel being rotatably mounted about said shaft and having a pipe, said minute cannon wheel being rotatably mounted about said pipe;

a first contact point on one of said wheels of said going train;

a member fixed to said shaft for rotation therewith;

manual control means for setting said member to a position representative of an alarm time;

a second contact point on said member; and, alarm-producing means for producing an alarm when said first and second contacts touch.

20. An alarm timepiece as claimed in claim 19 and further comprising a dial borne by said support means, and index means coupled to said manual control means, and index means cooperating with said dial to indicate said alarm time.

21. An alarm timepiece as claimed in claim 19 wherein said minute cannon wheel includes a pipe, said alarm timepiece further comprising:

a dial;

an hours hand attached to the end of the pipe of said hours cannon wheel and a minutes hand attached to the end of the pipe of said minutes cannon wheel, said hours hand and said minutes hand cooperating with said dial to indicate time.

* * * * *